US006491543B1

(12) United States Patent
Yatskov

(10) Patent No.: US 6,491,543 B1
(45) Date of Patent: Dec. 10, 2002

(54) ELECTRICAL CIRCUIT CONNECTOR WITH TAPERED SURFACE

(75) Inventor: Alexander I. Yatskov, Kenmore, WA (US)

(73) Assignee: Cray Inc., Seattle, WA (US)

( * ) Notice: Subject to any disclaimer, the term of this patent is extended or adjusted under 35 U.S.C. 154(b) by 0 days.

(21) Appl. No.: 09/602,571

(22) Filed: Jun. 22, 2000

(51) Int. Cl.[7] ..... H01R 12/24

(52) U.S. Cl. ..... 439/493; 439/67; 439/66; 439/91

(58) Field of Search ..... 439/67, 493, 74, 439/65, 66, 91

(56) References Cited

U.S. PATENT DOCUMENTS

| | | | | | |
|---|---|---|---|---|---|
| 4,611,869 | A | * | 9/1986 | Bonnefoy | 439/67 |
| 4,647,125 | A | * | 3/1987 | Landi et al. | 439/67 |
| 4,850,883 | A | * | 7/1989 | Kabadi | 439/67 |
| 4,913,656 | A | * | 4/1990 | Gordon et al. | 439/67 |
| 4,948,374 | A | * | 8/1990 | Carter | 439/67 |
| 4,997,389 | A | * | 3/1991 | Doumani et al. | 439/493 |
| 5,161,981 | A | * | 11/1992 | Deak et al. | 439/66 |
| 5,730,619 | A | * | 3/1998 | Hamlin | 439/67 |

FOREIGN PATENT DOCUMENTS

| | | | | | |
|---|---|---|---|---|---|
| GB | 2183406 | A | * | 6/1987 | 439/67 |

OTHER PUBLICATIONS

Pokrzywa, R.S., "A High Density Pad–On–Pad Connector Utilizing a Flexible Circuit,", pp. 461–464, Copyright 1993.

Ling, Y. et al., "Finding the Constitutive Relation for a Specific Elastomer," presented at the Winter Annual Meeting, American Society of Mechanical Engineers, Anaheim, Ca, Nov. 8–13, 1992.

* cited by examiner

*Primary Examiner*—Tho D. Ta
(74) *Attorney, Agent, or Firm*—Harold H. Bennett, II; Seed IP Law Group PLLC

(57) ABSTRACT

An electrical connector includes a electrical connector extending between a pair of mechanical connectors to electrically couple circuits, and a supporting member between the mechanical connectors to reduce twisting of the electrical connector. The supporting member cambered to permit the mechanical connectors to translate with respect to one another. A clamping member includes a tapered clamping surface in an undeformed, unclamped position. The clamping member bends when in a clamped position, resulting in approximately planar clamping surface. Resilient pressure pads on the clamping members bias the electrical connector to the circuit board. The pressure pads are mounted in wells in the clamping members to support a sidewall of the pressure pads. Frames provide additional support to the sidewalls of the pressure pads. The pressure pads include a raised edge along a periphery of a contact surface of the pressure pad. Additionally, or alternatively, a support shoulder in the well cooperates with a recess along a periphery of a mounting surface of the pressure pad to support the sidewall. Alignment structure on the frame cooperates with alignment structure on the clamping members, the printed circuit boards and the electrical connectors to align contacts on the electrical connectors with contacts on the printed circuit boards, and to further align the pressure pads with the contacts.

41 Claims, 6 Drawing Sheets

ELECTRICAL CIRCUIT CONNECTOR WITH TAPERED SURFACE

TECHNICAL FIELD

This invention relates to electrical connectors, and more particularly to an improved socket for electrical connectors coupled to printed circuit boards.

BACKGROUND OF THE INVENTION

Many computing devices, such as desktop computers, workstations, mainframe and super-computers employ multiple printed circuit boards ("PCB") that include various microprocessors, printed circuits and other components that must be electrically coupled together to transmit data and/or power. The electrical traces on one or more layers of the printed circuit board form the printed circuits and typically terminate in one or more terminals or contacts for making connections. Every decreasing element sizes, such a pitch (i.e., the spacing between successive components), width, and height, exacerbate the problem of providing secure and reliable connections between the printed circuits. Precise positioning on the order of thousandths of an inch is often necessary. Consistent pressure across each of the many contacts is also desirable to assure a reliable connection. A single failed or intermittent connection of a contact on a printed circuit board can result in large amounts of "downtime" for the computing device, and costly troubleshooting by highly skilled technicians.

A reliable, precise, and highly manipulable electrical connector is required to couple printed circuits between printed circuit boards. Additionally the connection should be secure over a time period commiserate with the expected life of the computing device to avoid costly maintenance and should allow easy replacement and/or addition of various computer components such as printed circuit boards.

SUMMARY OF THE INVENTION

According to principles of the invention, a clamping member of an electrical connector is thicker in a central region than in the end region. The clamp includes a bar that is tapered from the center to the edges when in an undeformed state and unclamped position. The bar is deformed under a force applied at the ends as the clamping members are moved into a clamped position. The result is a generally planar clamping surface when the clamping members are in the clamped position.

BRIEF DESCRIPTION OF THE DRAWINGS

In the drawings, identical reference numbers identify similar elements or acts. The sizes and relative positions of elements in the drawings are not necessarily drawn to scale and various elements and portions of elements may be are arbitrarily enlarged and positioned to improve drawing legibility.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with computers, printed circuit boards, circuits and mechanical clamps have not been shown or described in detail to avoid obscuring descriptions of the embodiments of the invention.

Figure 1:
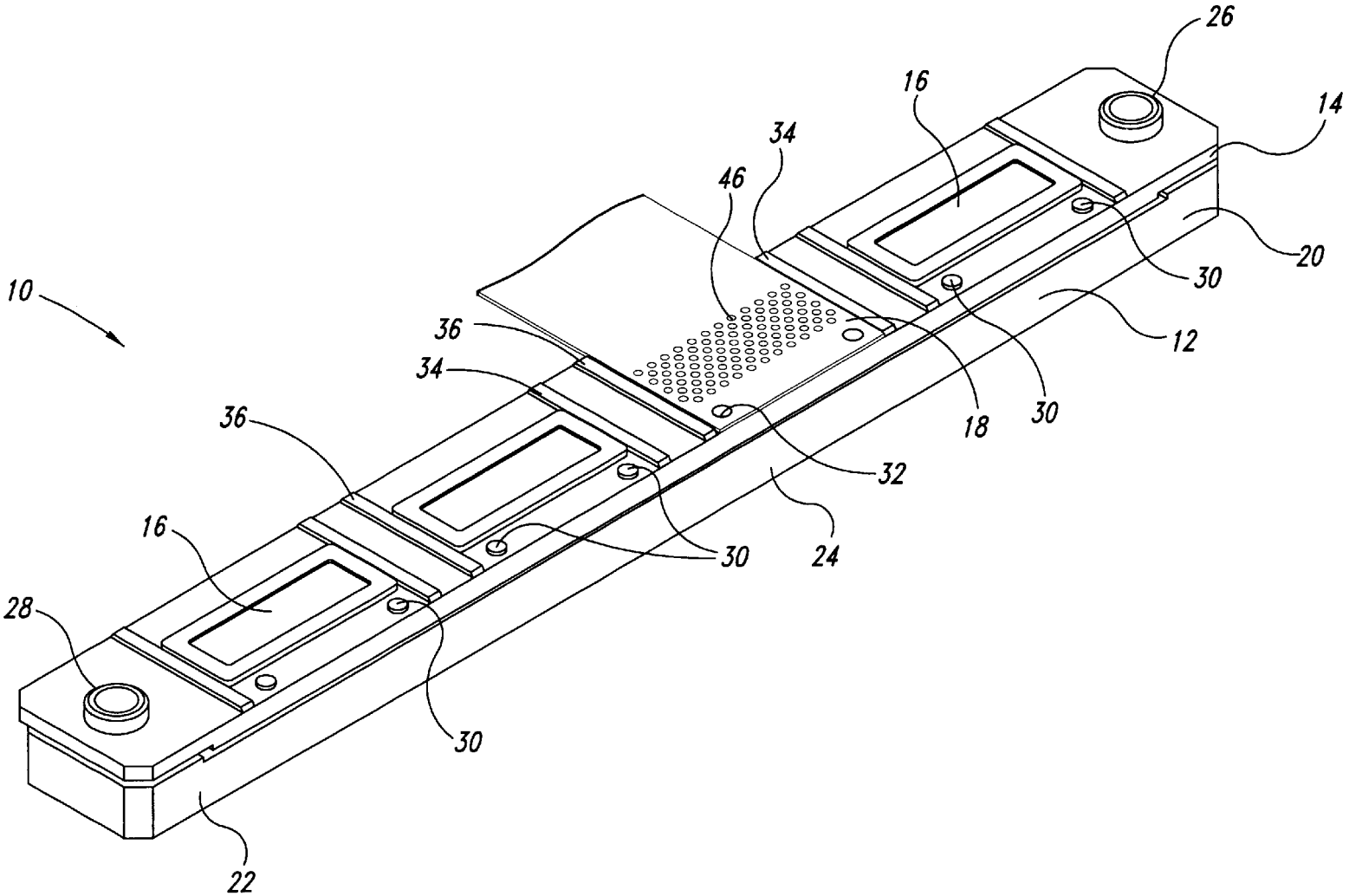
FIG. 1 is an isometric view of a clamping assembly and electrical connector according to the present invention.

FIG. 1 shows a clamping assembly 10 composed of a clamping member 12, a frame 14 and pressure pads 16. An electrical connector 18 is shown in position ready for connection to a circuit board by clamping assembly 10. The clamping member 12 has a first end 20 and a second end 22 and a central portion 24. According to a preferred embodiment of the present invention, the central portion 24 is somewhat thicker than at the ends 20 and 22. This will be explained, and shown in more detail, with respect to FIGS. 5–8. Posts and collars 26 and 28 are provided at each of the ends 20, 22 respectively in order to receive and provide alignment with frame 14.

Figure 5:
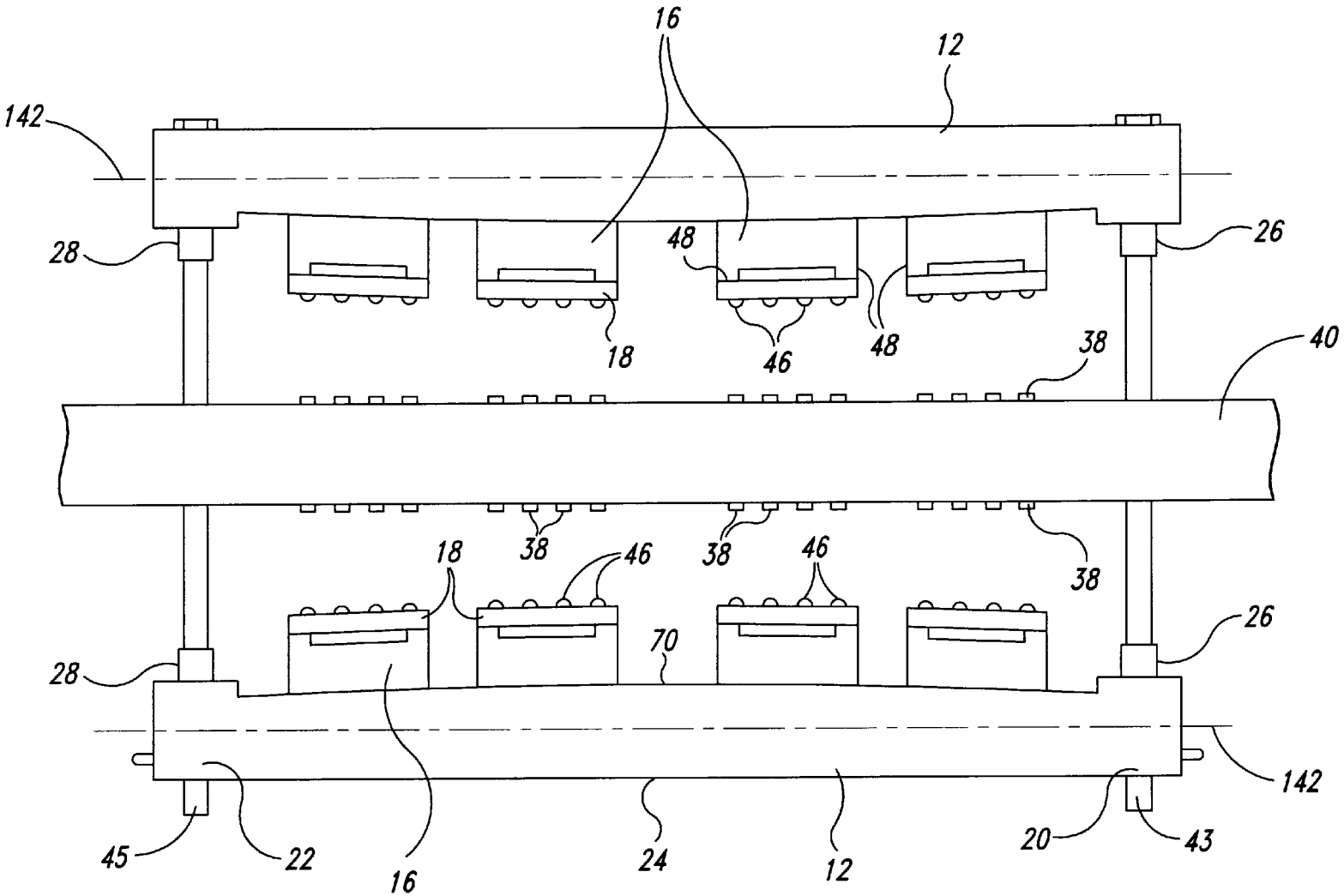
FIG. 5 is a front elevational view of the printed circuit board and electrical connectors received between the clamping members and pressure pads that are undeformed while in an unclamped position.
Figure 6:
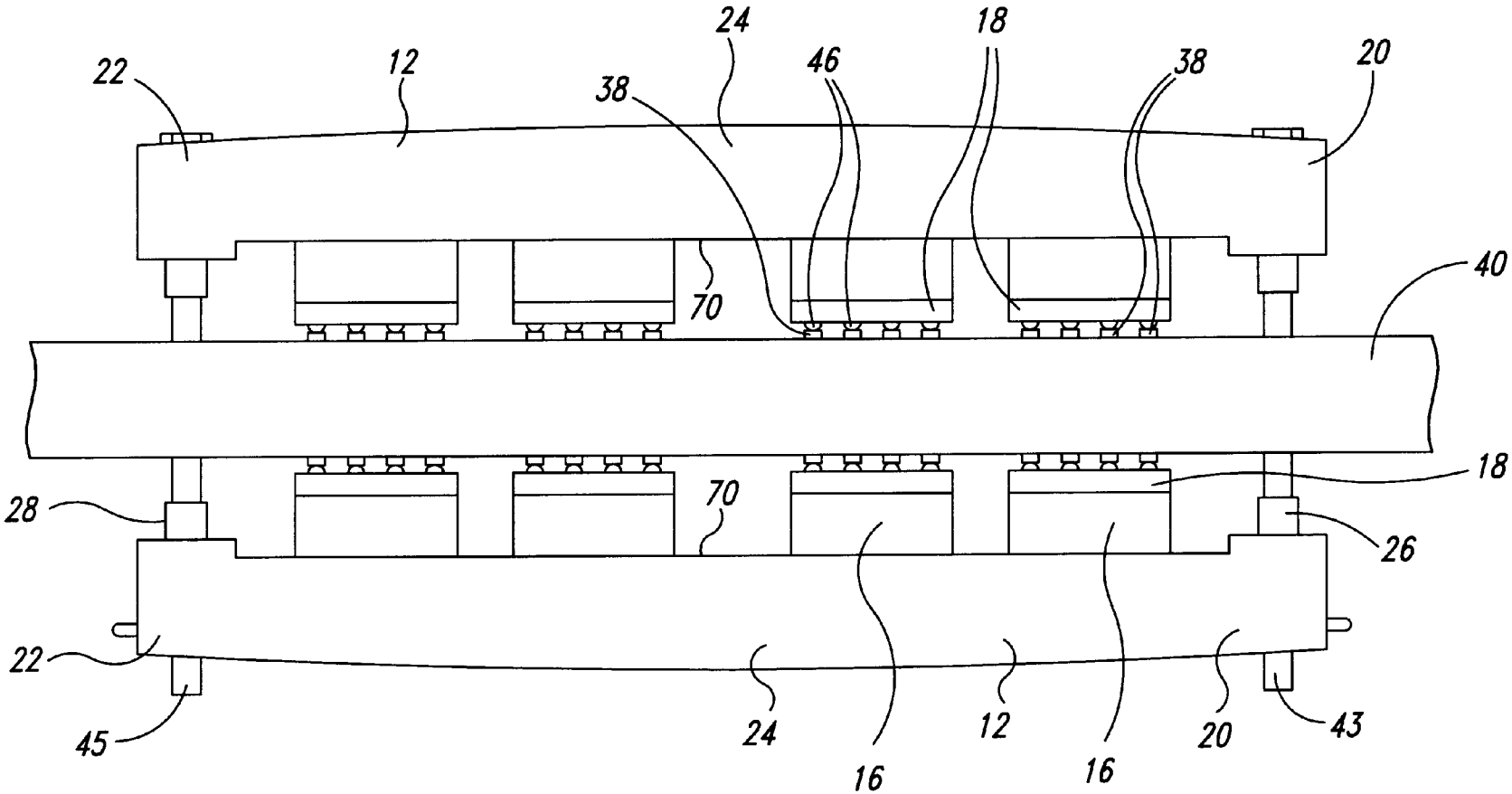
FIG. 6 is a front elevational view of the printed circuit board and electrical connectors received between the clamping member and pressure pads that are deformed while in the clamped position.

Frame 14 rests on top of and in alignment with clamping member 12. The frame 14 includes an electrical connector alignment structure in the form of a set of pins 30 sized and dimensioned to engage a pair of holes 32 in the end of the electrical connector 18. The pins 30 align a plurality of electrode contacts 46 on an end of the electrical connector 18 with the respective pressure pad 16. The alignment structure may also include, in an alternative embodiment, horizontal guide bars 34 and 36 on either side of the strip so as to position it in the proper location on the pressure pad 16. In some embodiments, guide bars 34 and 36 are not used and instead the pressure pad and pins 30 are in a recess to provide alignment. Of course, any acceptable alignment structure can be used, and those shown here are merely given for example to illustrate ways in which the electrical connector 18 can be ensured to have proper alignment on top of the pressure pad 16 to make good electrical contact when the clamping occurs, as shown in FIGS. 5 and 6. The alignment structure on the clamping members 12, frames 14 and electrical connectors 18 cooperate to ensure that the contacts 46 on the electrical connectors 18 precisely align with the contacts 38 (FIGS. 5 and 6) on the surfaces of the respective printed circuit boards 40. Precise alignment is important to providing secure, reliable electrical connections.

Figure 2:
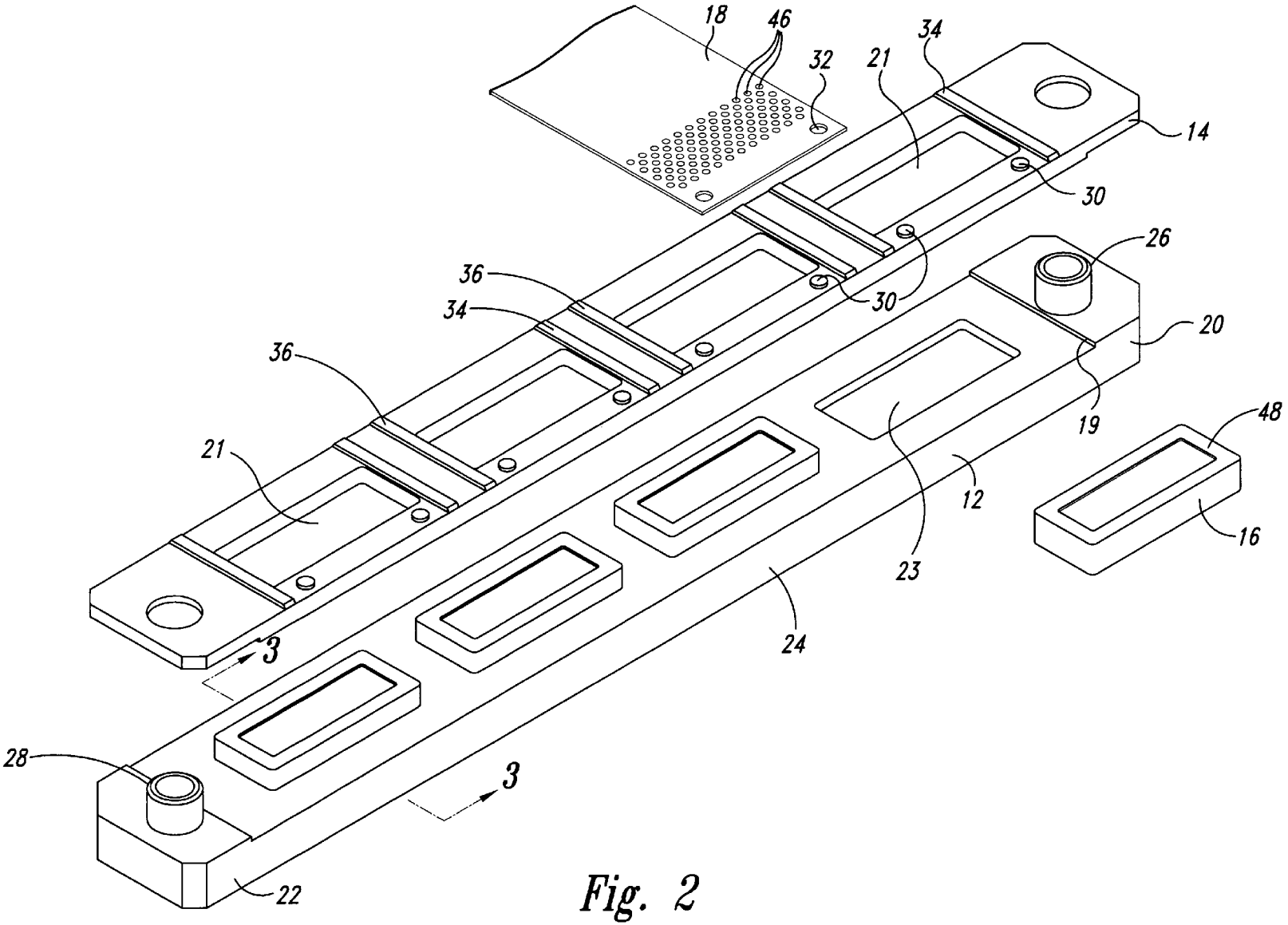
FIG. 2 is an exploded front, right isometric view of the clamping member of FIG. 1.

FIG. 2 shows an exploded view of the clamping assembly 10. The clamping member 12 includes a recess 23 into which the pressure pads 16 are positioned. The pads 16 may be held in position by a pressure fit, or by adhesive is desirable, either method being acceptable. The pressure pad 16 includes a raised edge 48 as described in more detail later with respect to FIGS. 3 and 4. The clamping member 12 may include a shoulder 19 adjacent each end in order to provide additional alignment with the frame 14; however, this is an optional alignment structure, and different or additional structures can be used.

The frame 14 is shaped to be positioned on top of and aligned with the clamping member 12. It contains apertures in each end to align with the posts and collars 26 and 28 of the clamping member as well as a shoulder mating portion to align and mate with the shoulder 19. Other configurations may also be used to mate and align the frame 14 with the clamping member 12.

The frame 14 contains apertures 21 that align with and surround pads 16. The sidewalls of the apertures 21 provide support to the sidewalls of the pad 16 so as to provide a solid surface for even pressure to the electrical contact members 46. This arrangement of the frame 14, together with the pad 16 and the clamping member 12 provides for the easy assembly of the clamping assembly 10 as a whole. It also ensures proper and correct alignment of the electrical contacts 46 with the printed circuit boards.

In an alternative embodiment, the frame 14 is not used. Instead, the recesses 23 and the clamping member 12 are made deeper and the pad 16 is positioned within the deep recess to provide support to the sidewalls. In addition, the alignment structures 30 are positioned on the clamping member 12 to align and mate with the apertures 32 of the electrical connectors 18.

The frame 14 includes on its upper surface raise guides 34 and 36 to provide an additional alignment structure for the electrical connector 18 when it is connected to clamping assembly 10. When the clamping assembly 10 is fully assembled, it provides reliable alignment, with solid support for the electrical connectors 18 to be positioned thereon for later clamping to provide electrical connection to the printed circuit board 40.

Figure 3:
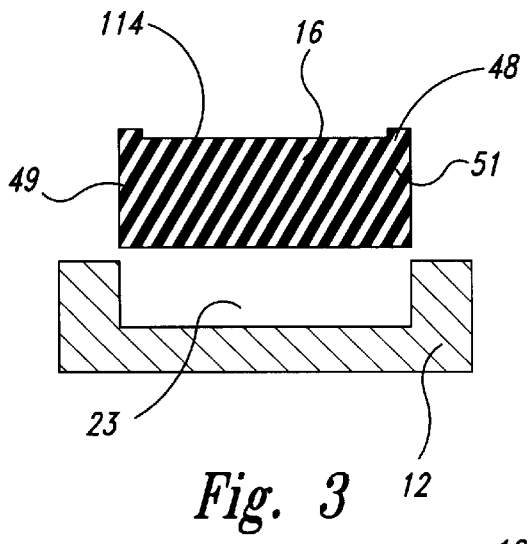
FIG. 3 is a partial, cross-sectional view of the member and resilient pad of FIG. 2 taken along section lines 3—3 of FIG. 2.

As shown in FIG. 3, each of the pressure pads 16 include a raised edge 48 along a periphery of the upper surface of the pressure pad. The upper surface of the pressure pad 16 contacts the end portion of the electrical connector 18 to bias the contacts 46 of the electrical connector against the contacts 30 (FIGS. 5 and 6). There is a tendency for the periphery of the resilient pressure pads 16 to sag downward and the sidewalls 49 and 51 bulge outward as the clamping assembly 10 applies pressure to the connector 18. The raised edge 48 counteracts this tendency and helps to evenly distribute the pressure exerted on the electrical contacts 46 through the pressure pads 16 when the clamp is shut. The frame 14, and the recess 23 in the clamping member 12, each support the sides walls 49 and 51 of the pressure pads 16 to also alleviate the tendency for them to bulge. As an alternative, instead of a separate, discrete frame 14, the frame 14 can be an integral portion of the clamping members 12, for example an upright edge surrounding each of the recesses 23, or the recesses 23 could be made deeper.

As shown in FIG. 3 in a cross-sectional view, the pressure pad 16 fits into recess 23. The dimensions of the pressure pad 16 are slightly larger than the dimensions of the recess 16 to achieve a press fit of the pressure pad 16 in the recess 16. The press fit deforms the pressure pad 16, increasing the rigidity of the pressure pad 16 and reducing the tendency of the sidewalls 49 and 51 of the pressure pad 16 to bulge under pressure. Adhesive can be added if desired to provide rigidity to the mounting in addition to the press fit. The raised edges 48 can be achieve by molding, or by removing material from a center portion of the pressure pad 16.

Figure 4A:
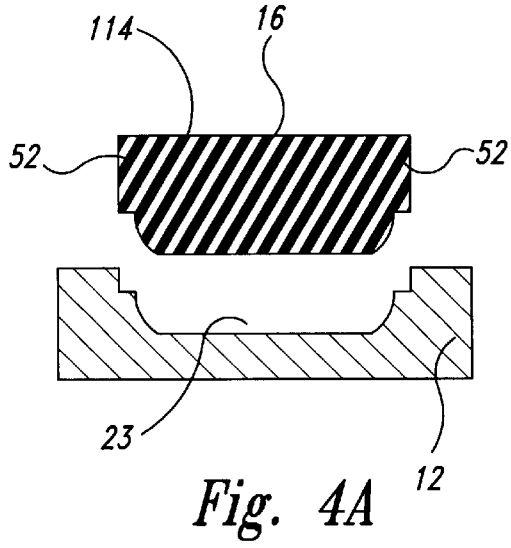
FIGS. 4A–4D are a partial, cross-sectional view of an alternative embodiment of the resilient pad of FIG. 3.

FIGS. 4A–4D show alternative embodiments of the pressure pad 16 and the recess 23. In FIG. 4A, the pressure pad 16 has an approximately planar contacting surface and a shoulder 52 formed along a peripheral edge of contacting surface 114 the pressure pad 16. The shoulder 52 extends around the periphery, and beyond the outer edge of the contact area 114 for the electrical contacts 46. The shoulder 52 thus provides additional lateral support for the upper surface so as to prevent the bulging of the sidewalls and retain the upper surface in a generally planar configuration during clamping. The recess 23 includes a support surface 54 for the pressure pad 16 about the periphery of the mounting surface. The shape of the shoulder 52 conforms to the shape of the recess 23 in the clamping member 12. The support shoulder 52 assists in countering the tendency of the sidewalls 51 and 49 of the pressure pad 112 to bulge under pressure. The pressure pad 112 is again press fit into the recess 23.

Figure 4B:
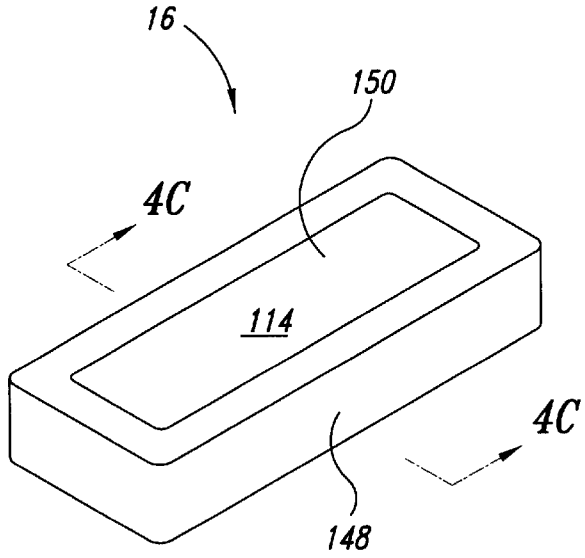
Figure 4C:
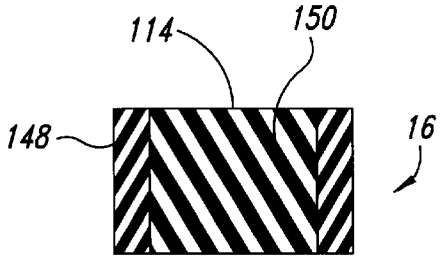
Figure 4D:
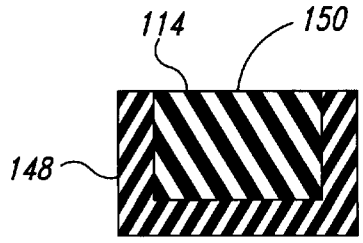

FIGS. 4B–4D illustrate further alternative embodiments of the pressure pad 16 according to principles of the present invention. The pad 16 includes a central member 150 composed of a first material and a second material 148 that is connected along the sidewalls of the material 150. Both of the materials, 150 and 148, can be a rubber or other deformable member. However, the material 148 is slightly more firm than the material used for 150. For example, the material 148 may be a somewhat harder rubber, or have a more firm response because it is a stiffer elastomeric member than the central portion 150. Having the pressure pad 16 composed of a two-part material also provides the advantage that when pressure is applied to the upper surface 114, the pad 16 will remain flat and uniform across this entire surface and provide an even support across the entire upper surface 114 so as to provide solid electrical contact of all pads 46.

FIG. 4C is a cross-sectional view taken along lines **4*c*—4*c* of FIG. 4*b* to illustrate the two materials 150 and 158 which comprise the pad 16. The outer layer 148 can be a sleeve into which the pad 150 is placed. In this embodiment, the pad 150 is slightly larger than the aperture in sleeve 148** so that the pad is compressed and held firmly in position.

FIG. 4D is a further alternative embodiment of pressure pad 16 in which the material 148 is like a box having a bottom as well as on the sidewall. This embodiment can be used to provide firm support inside the recess 23 and may be used in place of, or in addition to, an adhesive. The material 148 may also be of the type which works better with the adhesive than the material 150 and thus provides a good contacting surface for bonding the pad 16 to the clamp 12.

As previously stated FIGS. 4B–4D show an alternative embodiment of the resilient pressure pad 112, including a pressure pad sleeve 148 receiving a pressure pad core 150. The pressure pad sleeve 148 has a durometer value greater than a durometer value of the pressure pad core 150. The pressure pad sleeve 148 has an aperture 152 having dimensions slightly smaller than corresponding dimensions of the pressure pad core 150, to receive the pressure pad core 150 in a press fit. Thus, the pressure pad sleeve 148 supports the sidewall 154 of the pressure pad core 150. As seen in FIG. 4C, the aperture 152 can extend completely through the pressure pad sleeve 148, or can extend only partially through the pressure pad sleeve 148 as shown in FIG. 15. The contacting surface 114 of the pressure pad core 150 is disposed over the contacts 46 on the end portion 48 of the electrical connector 18 to ensure that constant pressure is applied across the contacts 46. The pressure pad sleeve 148 does not directly over any of the contacts 46, and so does not directly apply force to the contacts 46. The pressure pad sleeve can be mounted to the clamping surface 70, or within the wells 108 of the clamping members 58, 60.

FIG. 5 shows two clamping members 12 and the pressure pads 10 undeformed, while the clamping members 12 are in the unclamped position. The frames 14 are not shown to improve the legibility of the drawing. The clamping surface 70 of the clamping member is tapered from a centerline 142, out toward the ends 20 and 22 of the clamping member 12. For example, a taper producing an angle θ of approximately 0.573 degrees may be sufficient. Tapers in the ranges of 0.1 to 2.0 degrees may be used. (The taper is not shown to scale in the figure, but shown enlarged for purposes of illustration.) Hence, the space between the clamping members 12 and board 40 increases towards the ends 20 and 22 near clamping bars 43 and 45. Similarly, the space between the electrical connectors 18 on pressure pads 16 and contacts 38 increases towards the ends 20 and 24 along the length of the clamping member 12 in anticipation of the bending of the clamping members 12 when they are to be clamped. As can be appreciated, when rods 43 and 45 apply force to hold the clamp 12 solid against the printed board 40, the force will be applied mostly at the end portions 20 and 22, thus deforming the bar 12. It is desirable to ensure that all electrical contacts between the connector 18 via contact points 46 and the printed circuit board 40 having contact electrodes 38 are precisely made, with uniform pressure applied to all contacts.

Accordingly, the principle of the present invention provides uniform pressure when clamped of all electrical connectors 18 of electrodes 46 to electrodes 38 by ensuring that even pressure is provided along the entire length of the bar 12 even though it is clamped at both ends. The pressure pads 16 are also configured to provide even pressure across the entire surface of the pad for each of the electrical contacts 46 when in the clamped position. As shown in FIG. 5, the pressure pads 16 have a slight upstanding ridge 48 around the edge portions, also as shown in the embodiment of FIG. 3. Once the clamps 12 are pressed firmly against the circuit board 40, the pressure pads 16 will be deformed to be uniformly flat across their entire surface and in addition the clamping members 12 will be uniformly flat along the surface which is presented to the printed circuit board 40, as shown in FIG. 6.

FIG. 6 shows the clamping members 12 of FIG. 5, with the clamping member 58 in a clamped position 6n circuit board 40. The taper in the clamping member 12 accommodates the bending of the clamping member 12 to produce an approximately planer clamping surface 70 when the clamping member 12 is in the clamped position. Hence, each of the pressure pads 16 exert a uniform pressure on their respective electrical connectors 18 and printed circuit boards 40.

As can be seen by FIG. 6, when the force is applied through clamping rods 43 and 45 to the end portions 20 and 22, respectively, the member 12 is brought into flat alignment with the printed circuit board 40 and the clamping surface 70 becomes uniformly flat across its entire surface. The clamp member 12 bulges out slightly on a back surface as it is clamped at both ends. This provides even and steady pressure to the rubber pad 16 in supporting the electrical connectors 18 and contact between electrodes 38 and 46 without such uniform pressure, some of the contacts 46 and 38 may not be touched to each other, creating an electrical open circuit.

In addition to the slight deformation of the clamping member 12, the pads 16 also undergo a slight deformation along their edge surfaces. The upstanding edge 48 is slightly depressed by the edge portions of the electrical circuit board 18. Those electrical connectors 46 which are on the outermost edges of the electrical connector 18 are provided the same support and even pressure as those at the center portion of the pad 16. Thus, uniformly flat, and even pressure contact surface 114 is provided to the electrical connectors 46 and 38 to hold them in contact with each other for an extended period of time.

The design of the present invention has the advantage that solid electrical contact is assured over long periods of time with high reliability. Over time, the metal, as well as the rubber, may fatigue slightly. The design of the present invention takes such fatigue into account so as to ensure that even pressure is applied over the life of the electrical connection. In addition, in the event that the electrical connectors are to be removed, the clamp member 12 can be easily removed and appropriate adjustments made and then reconnected with a high degree of assurance that even pressure will be applied to all electrical connectors 46 and 38 without loss of connection.

Figure 7:
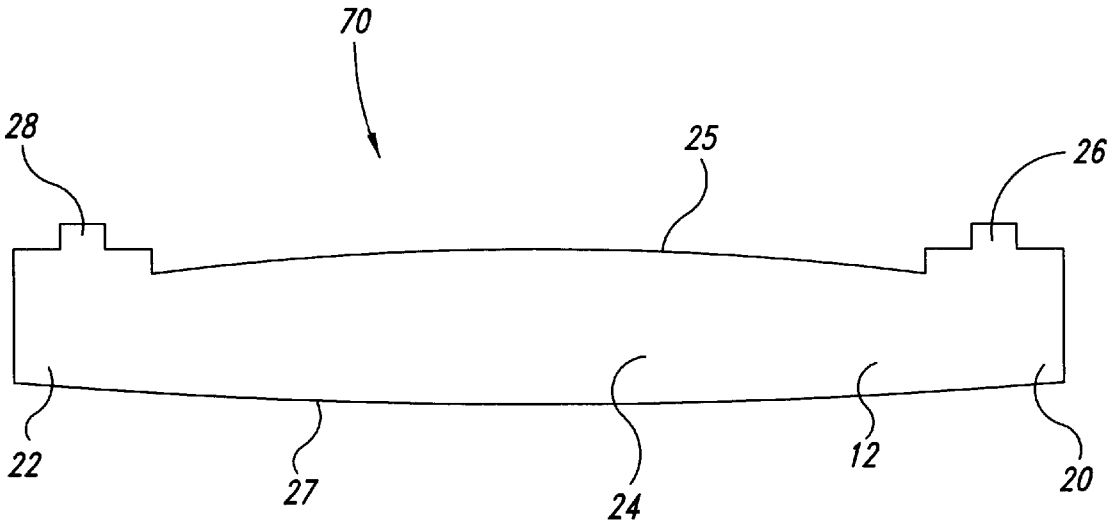
FIG. 7 is a front elevation of an alternative embodiment of the clamping member.
Figure 8:
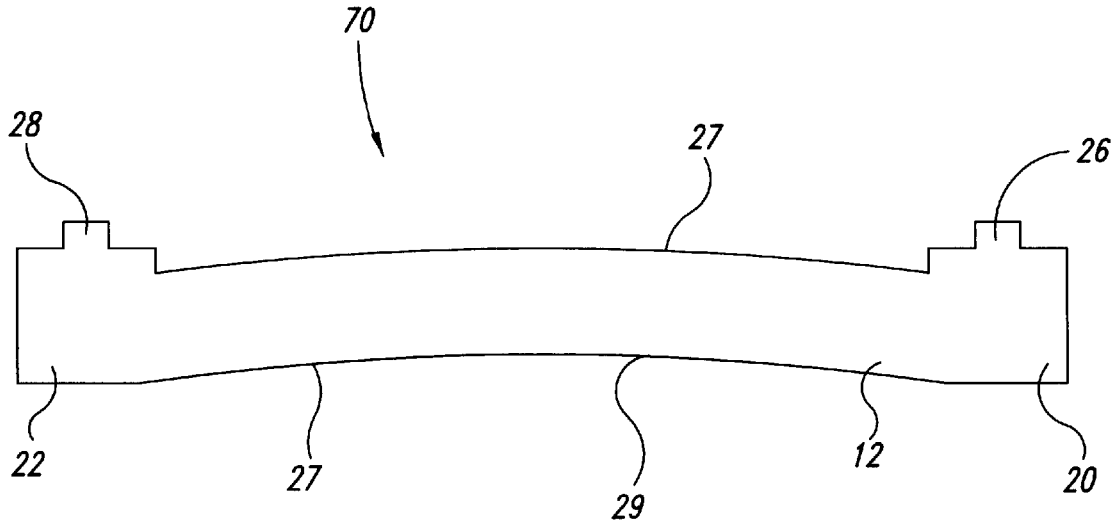
FIG. 8 is a front elevation of a further alternative embodiment of the clamping member.

FIGS. 7 and 8 illustrate alternative members of the clamp 12 which may be used according to principles of the present invention. The clamp 12 of FIG. 7 tapers from the center portion outward along both surfaces so as to be somewhat thinner in the portions 20 and 22 both on the top surface and on a bottom surface. The central portion 24 thus has a bulge on both the top and bottom, as can be seen in the exaggerated FIG. 7. FIG. 5 is an alternative embodiment in which a bulge 25 occurs only along the top surface. In this instance, the bottom surface 27 is generally flat between end regions 20 and 22 and does not have a taper or other additional material thereon. The upper surface, which becomes the clamping surface 70, however, does include a bulge 25 so that the clamping member 12 is slightly thicker at the central region 24 than at the ends 20 and 22. In this alternative embodiment, the taper to create the bulge 25 may be somewhat larger than that which is used for the taper as shown in FIG. 5, since it is only a single surface that is tapered and not both surfaces. The amount of taper for the bar 12 will of course depend on the amount of force used in clamping the bar as well as the anticipated deformation of the bar under clamping, as can be easily calculated based on the design of each individual clamping member 12. Accordingly, the amount of taper used in each of the embodiments, for FIGS. 5–8, will be based on the taper needed to present a uniformly flat and even pressure clamping surface 70 once the clamping member 12 is connected to the board 40 to provide electrical contact.

FIG. 8 shows a further alternative embodiment according to principals of the present invention. In this embodiment, the clamping member 12 has a uniform thickness from one end 20 to the other end 22. However, the central portion is arched slightly upward so as to present a slightly increased pressure in the central region. Thus, the upper surface 70 which becomes the clamping surface has a slight arch 27 between the ends, and this arch is exactly the same radius as the arch 29 from the bottom surface 27 so even though the clamping member has a uniform thickness between 20 and 22, it will provide additional pressure in the central regions so as to have uniform pressure across this entire length when in the clamped position.

Although specific embodiments of and examples for, the invention are described herein for illustrative purposes, various equivalent modifications can be made without departing from the spirit and scope of the invention, as will be recognized by those skilled in the relevant art. The teachings provided herein of the invention can be applied to other electrical connectors, not necessarily the exemplary clamping electrical connector generally described above.

The various embodiments described above can be combined to provide further embodiments. All of the above U.S.

patents, patent applications and, publications referred to in this specification are incorporated by reference. Aspects of the invention can be modified, if necessary, to employ systems, circuits and concepts of the various patents, applications and publications to provide yet further embodiments of the invention.

These and other changes can be made to the invention in light of the above-detailed description. In general, in the following claims, the terms used should not be construed to limit the invention to the specific embodiments disclosed in the specification and the claims, but should be construed to include all connectors and clamping devices that operate in accordance with the claims. Accordingly, the invention is not limited by the disclosure, but instead its scope is to be determined entirely by the following claims.

I claim:

1. A circuit board connector, comprising:

an elongated first clamping member having a first alignment structure, a first and a second opposed ends and a first clamping surface;

an elongated second clamping member having a second alignment structure, first and second opposed ends and a second clamping surface generally facing the first clamping surface of the first clamping member where the first and the second clamping members are movable with respect to one another between a clamped position to secure a flexible circuit path to a circuit board and an unclamped position spaced from the clamped position, at least one of the first and the second clamping surfaces having a rise toward a middle point between the first and the second opposed ends thereof when the clamping members are in the unclamped position;

a first frame having a clamping member alignment structure sized and dimensioned to mate with the first alignment structure; and a second frame having a clamping member alignment structure sized and dimensioned to mate with the second alignment structure.

2. The circuit board connector of claim 1 wherein both the first and the second clamping surfaces have a rise toward the middle point between the first and the second opposed ends thereof when the clamping members are in the unclamped position.

3. The circuit board connector of claim 1 wherein the at least one of the first and the second clamping surfaces having the rise toward the middle point when the first and the second clamping members are in the unclamped position is approximately planar when the first and the second clamping members are in the clamped position.

4. The circuit board connector of claim 1, further comprising:

a plurality of resilient pressure pads on the first clamping member.

5. The circuit board connector of claim 1, further comprising:

a plurality of resilient pressure pads partially located in a respective recess formed on the first clamping member.

6. The circuit board connector of claim 1 wherein the first and the second clamping members each include at least one threaded hole at each of a first and a second opposed ends thereof, and further comprising:

a first threaded clamp adjustment member engaging the threaded holes at the first end of each of the first and the second clamping members; and a second threaded clamp adjustment member engaging the threaded holes at the second end of each of the first and the second clamping members.

7. A clamp to electrically couple printed circuits, comprising:

a first clamping member having a first clamping surface and a thickness, and wherein the thickness of the first clamping member at a point between first and second ends thereof is greater than the thickness of the first clamping member at the first or second ends;

a second clamping member having a second clamping surface generally facing the first clamping surface; and at least a first threaded adjustment member engaging the first and the second clamping members to move the first and the second clamping members with respect to one another between a clamped position where the first and the second clamping members are spaced relatively closely together and an unclamped position where the first and the second clamping members are spaced relatively apart, and where a distance between the first and the second clamping surfaces varies along a length of the first clamping surface when the first and the second clamping members are in the unclamped position, and wherein the distance between the first and the second clamping surface does not vary along the length of the first clamping surface when the first and the second clamping members are in the clamped position.

8. The clamp of claim 7 wherein a thickness of the second clamping member tapers along the length thereof from a point between first and second ends toward each of the first and the second ends.

9. The clamp of claim 7, further comprising:

a number of resilient pressure pads on at least one of the first and the second clamping surfaces.

10. The clamp of claim 7, further comprising:

a number of resilient pressure pads on the first clamping member;

a number of resilient pressure pads on the second clamping member;

a first frame received between the first and the second clamping surfaces, the first frame having a respective opening for each of the pressure pads on the first clamping members, the openings sized and dimensioned to receive a respective one of the pressure pads on the first clamping member; and a second frame received between the first and the second clamping surfaces, the second frame having a respective opening for each of the pressure pads on the second clamping member, the openings sized and dimensioned to receive a respective one of the pressure pads on the second clamping member.

11. The clamp of claim 7, wherein the first clamping member includes an integral frame extending from the first clamping surface toward the second clamping surface, the frame being adjacent at least a first sidewall of a first resilient pressure pad.

12. The clamp of claim 7, further comprising:

a first frame received between the first and the second clamping surfaces, the first frame having a clamping member alignment structure to mate with an alignment structure on the first one of the clamping members and a flexible circuit path alignment structure to mate with an alignment structure on a first flexible circuit path; and a second frame received between the first and the second clamping surfaces, the second frame having a clamping member alignment structure to mate with an alignment structure on the second one of the clamping members and a flexible circuit path alignment structure to mate with an alignment structure on a second flexible circuit path.

13. The clamp of claim 12 wherein the flexible circuit path alignment structure on the first and second frames each include a number of pairs of pins and a number of pairs of openings, each of the pairs of pins aligned with a respective one of the pairs of openings on the frame, the pins sized to be received by holes formed in a substrate of a flexible circuit path.

14. A clamp for electrically coupling printed circuits, comprising:

a pair of opposed clamping members, the clamping members movable with respect to one another between a clamped position and an unclamped position spaced from the clamped position;

at least one nonconductive resilient pressure pad secured to at least one of the clamping members; and a first frame received between the opposed clamping members and having a respective opening for each of the pressure pads on a first one of the clamping members, the openings sized and dimensioned to receive the respective one of the pressure pads.

15. The clamp of claim 14 wherein the size of the openings is less than a size of the respective pressure pads, the openings receiving the pressure pads in a press fit.

16. The clamp of claim 14 wherein the first frame includes a clamping member alignment structure to mate with an alignment structure on a first one of the opposed clamping members.

17. The clamp of claim 14 wherein the first frame includes a flexible circuit path alignment structure to mate with an alignment structure on a first flexible electric circuit path.

18. The clamp of claim 14 wherein the frame is an elongated metal plate.

19. The clamp of claim 14, further comprising.

a second frame received between the first frame and a second one of the clamping members, the second frame having a respective opening for each of a number of the pressure pads on the second clamping member, the openings sized and dimensioned to receive the respective one of the pressure pads, the second frame having a clamping member alignment structure to mate with an alignment structure on the second one of the clamping members and a flexible circuit path alignment structure to mate with an alignment structure on a second flexible electric circuit path.

20. A clamp for electrically coupling printed circuits, comprising:

a first clamping member;

a second clamping member opposed to the first clamping member and moveable with respect thereto between a clamped position and an unclamped position;

a first set of resilient pressure pads secured to the first clamping member;

a second set of resilient pressure pads secured to the second clamping member;

a first frame received between the first and the second clamping members, the first frame having a respective opening for each of the pressure pads in the first set of pressure pads, the openings sized and dimensioned to receive the respective one of the pressure pads; and a second frame received between the second clamping member and the first frame, the second frame having a respective opening for each of the pressure pads in the second set of pressure pads, the openings sized and dimensioned to receive the respective one of the pressure pads.

21. The clamp of claim 20 wherein the size of the openings in the first and the second frames is less than a size of the respective pressure pads, each of the openings receiving the respective pressure pad in a press fit.

22. The clamp of claim 20 wherein the first frame includes a flexible circuit path alignment structure including a pair of posts for each of the openings to mate with an alignment structure on a flexible electric circuit path including a pair of holes in the flexible electric circuit path positioned and sized receive the posts to align a set of contacts on the flexible electric circuit path in the opening of the frame.

23. The clamp of claim 20 wherein the first frame includes a clamping member alignment structure to mate with an alignment structure on a first one of the clamping members, and a flexible circuit path alignment structure to mate with an alignment structure on a flexible electric circuit path.

24. A clamp for electrically coupling printed circuits, comprising:

a first clamping member;

a second clamping member opposed to the first clamping member and movable with respect thereto between a clamped position and an unclamped position spaced from the clamped position; and at least a first resilient pressure pad having a contacting surface and a raised edge along a periphery of the contacting surface, the first resilient pressure pad secured to the first clamping member for movement therewith such that the contacting surface of the first pressure pad generally faces the second clamping member, the contacting surface positioned to bias a flexible electric circuit path into contact with a circuit board in the clamped position.

25. The clamp of claim 24 wherein the raised edge extends along an entire length of the periphery of the contacting surface.

26. The clamp of claim 24 wherein the raised edge has a uniform height and a uniform width along an entire length of the periphery of the contacting surface.

27. The clamp of claim 24 wherein the first resilient pressure pad is mounted in a first recess formed in the first clamping member, the contacting surface of the first resilient pressure pad extending from the first recess.

28. The clamp of claim 24, further comprising:

a frame positioned between the first and the second clamping members, the frame having at least a first opening, the first resilient pressure pad press fit through the first opening.

29. The clamp of claim 24, further comprising:

a frame positioned between the first and the second clamping members, the frame having at least a first opening, a portion of the first resilient pressure pad including the contacting surface extending through the first opening, the frame further having a clamping member alignment structure to mate with an alignment structure on the first clamping member, and having a flexible electric circuit path alignment structure to mate with an alignment structure on the flexible electric circuit path.

30. The clamp according to claim 24 wherein the pressure pad comprises:

a pressure pad sleeve having a first durometer value and an aperture; and a resilient pressure pad core received in the aperture of the pressure pad sleeve such that a contact surface of the pressure pad core is exposed, the pressure pad core having a second durometer value less than the first durometer value of the pressure pad sleeve.

31. The clamp of claim 30 wherein the pressure pad core is in press fit contact with the pressure pad sleeve.

32. The clamp of claim 30 wherein the aperture extends through the pressure pad sleeve.

33. A printed circuit connector, comprising:

a clamping member having a first end, a second end and a middle region and having a first surface and a second surface and a thickness extending from the first surface to the second surface, the thickness at the middle region being greater than the thickness at the first and second ends and configured to bias a lower surface of a first printed circuit against an upper surface of a second printed circuit; and a plurality of fasteners for clamping the first and second ends to a selected surface, providing thereby a force for the biasing.

34. The printed circuit connector of claim 33, further comprising a resilient member interposed between the first surface of the clamping member and an upper surface of the first printed circuit, the resilient member configured to receive a biasing force from the first clamping member and transmit the biasing force to the first printed circuit, and further configured to distribute, by virtue of its resiliency, the biasing force evenly across a contact region of the first printed circuit.

35. The printed circuit connector of claim 33 wherein the clamping member is a first clamping member and the selected surface is a second clamping member configured to bias an upper surface of a third printed circuit against a lower surface of the second printed circuit.

36. The printed circuit connector of claim 35, further comprising:

a first resilient member interposed between the first surface of the first clamping member and an upper surface of the first printed circuit, the first resilient member configured to receive a first biasing force from the first clamping member and transmit the first biasing force to the first printed circuit, and further configured to distribute, by virtue of its resiliency, the first biasing force evenly across a contact portion of the first printed circuit; and a second resilient member interposed between the second clamping member and a lower surface of the third printed circuit, the second resilient member configured to receive a second biasing force from the second clamping member and transmit the second biasing force to the third printed circuit, and further configured to distribute, by virtue of its resiliency, the second biasing force evenly across a contact portion of the third printed circuit.

37. A circuit connector, comprising:

a first clamping bar;

a second clamping bar, the first and second clamping bars configured to bias a plurality of flexible circuits, each including an own plurality of contact pads, against a first surface of a printed circuit board;

a plurality of fasteners configured to draw the first and second clamping bars together; and a plurality of resilient pads, each of the plurality of pads being positioned on a first surface of the first clamping bar such that biasing force exerted by the first clamping bar is distributed by the plurality of pads to bias each of the own plurality of contact pads on each of the plurality of flexible circuits against a corresponding one of a plurality of printed circuit contacts on the first surface of the printed circuit board.

38. The circuit connector of claim 37 wherein:

the plurality of resilient pads is a first plurality of resilient pads;

the plurality of circuits is a first plurality of flexible circuits;

the plurality of printed circuit contacts is a first plurality of printed circuit contacts;

the first and second clamping bars are further configured to bias a second plurality of flexible circuits, each including an own plurality of contact pads, against a second surface of the printed circuit board;

the circuit connector further comprises a second plurality of resilient pads, each of the second plurality of pads being positioned on a first surface of the second clamping bar such that biasing force exerted by the second clamping bar is distributed by the second plurality of pads to bias each of the own plurality of contact pads on each of the second plurality of flexible circuits against a corresponding one of a second plurality of printed circuit contacts on the second surface of the printed circuit board.

39. The circuit connector of claim 38, wherein each of the first and second pluralities of resilient pads fits into a corresponding one of a plurality of depressions in the first surface of the first or second clamping bars.

40. A circuit connector comprising:

a clamping bar configured to bias a lower surface of a flexible circuit, having a plurality of contacts, against an upper surface of a printed circuit board, having a corresponding plurality of printed circuit contacts;

a resilient member having an upper surface configured to contact a lower surface of the clamping bar and a lower surface configured to contact an upper surface of the flexible circuit and configured to transmit a biasing force from the clamping bar to the printed circuit, the resilient member being sized and shaped such that the lower surface of the resilient member covers an area on an upper surface of the flexible circuit opposite the plurality of contacts on the lower surface of the flexible circuit, the lower surface of the resilient member having a raised edge around a perimeter of the lower surface, the raised edge configured to compensate for a tendency of the resilient member to bulge around the perimeter when biasing force is applied by the first clamping bar, providing thereby an equal biasing force on each of the plurality of contacts.

41. The circuit connector of claim 40 wherein:

the flexible circuit is one of a plurality of flexible circuits;

The clamping bar is configured to bias a lower surface of each of the plurality of flexible circuits against an upper surface of the printed circuit board;

the resilient member is one of a plurality of resilient members, each having an upper surface configured to contact the lower surface of the clamping bar and a lower surface configured to contact an upper surface of one of a plurality of flexible circuits; and each of the resilient members is configured to transmit a biasing force from the clamping bar to a corresponding one of the plurality of flexible circuits.

* * * * *